United States Patent [19]

Nakajima

[11] Patent Number: 4,559,756

[45] Date of Patent: Dec. 24, 1985

[54] APPARATUS FOR PACKING POWDERED MATERIALS INTO SACK HAVING SEALING MEMBER

[75] Inventor: Shigeo Nakajima, Kyoto, Japan

[73] Assignee: Nakajima Seisakusho Co., Ltd., Japan

[21] Appl. No.: 585,898

[22] Filed: Mar. 2, 1984

Related U.S. Application Data

[62] Division of Ser. No. 458,980, Jan. 18, 1983, abandoned.

[30] Foreign Application Priority Data

Jan. 30, 1982 [JP] Japan ..... 57-013959

[51] Int. Cl.[4] ..... B65B 1/30; B65B 7/06

[52] U.S. Cl. ..... 53/75; 53/268; 53/371

[58] Field of Search ..... 53/75, 502, 270, 268, 53/570, 371, 52, 481, 469; 383/52

[56] References Cited

U.S. PATENT DOCUMENTS

| | | | |
|---|---|---|---|
| 2,104,154 | 1/1938 | Du Bois | 53/371 |
| 2,893,184 | 7/1959 | Lienart | 53/75 |
| 2,922,612 | 1/1960 | Bulls et al. | 53/570 X |
| 3,167,241 | 1/1965 | Woerner | 383/52 |
| 3,995,408 | 12/1976 | Guenther et al. | 53/570 X |
| 4,003,188 | 1/1977 | Lau | 53/570 X |
| 4,219,054 | 8/1980 | Carter et al. | 53/570 X |

*Primary Examiner*—Horace M. Culver

*Attorney, Agent, or Firm*—Brumbaugh, Graves, Donohue & Raymond

[57] ABSTRACT

A sack (2,2') comprises a sealing member (1,1') which is provided at an appropriate position of the sack (2,2'), and a dried adhesive agent is spread on the inner walls of the sealing member (1,1'). A supply pipe (3) comprises a curved head from which a nozzle (21) projects. The supply pipe (3) is inserted to supply powdered materials into the sack (2,2') via an aperture of the sealing member (1,1'), and then, after supply, the pipe (3) comes within the inner walls of the sealing member (1,1') where an activator is jetted from the nozzle (21). Sealing of the sack (2,2') is performed as it falls from a supporting member (30), owing to the outward pressure of the powdered materials supplied in the sack (2,2').

2 Claims, 10 Drawing Figures

APPARATUS FOR PACKING POWDERED MATERIALS INTO SACK HAVING SEALING MEMBER

This application is a division of application Ser. No. 458,980, filed on Jan. 18,1983 and now abandoned.

BACKGROUND OF THE INVENTION

This invention is broadly concerned with a sack for packing powdered materials therein, and is particularly concerned with a sack with a sealing member by which the sack is sealed off containing the powdered materials therein.

This invention is also directed to a method and an apparatus for packing powdered materials into a sack.

One conventional method for packing powder materials into a sack and for sealing off the sack containing the powdered materials involves supplying powdered materials into a sack through a supply pipe inserted into a sealing member of the sack, and thereafter jetting an appropriate dose of an adhesive agent from slits or fine holes, arranged on the cylindrical surface of the supply pipe, to the inner surface of the sealing member mounted at a predetemined position of the sack. In this manner, adhesive is applied to the sealing member, so that the sack containing the supplied powdered materials therein can be sealed off because the sealing member is pressed outward by the powdered materials contained in the sack when the sack is released from the supply pipe.

In such a prior method, however, there have been various problems. For example, the slits or fine holes arranged on the cylindrical surface of the supply pipe, which tend to be damped by an adhesive agent, may be inconveniently bunged because of the agglutination of powdered materials when the supply pipe is released from the sack. Moreover, it is difficult to clean the bunged slits or holes particularly when the packing operation is restarted after a long discontinuance. Thus it is necessary to clean manually the bunged slits or holes every time the packing operation is to be restarted, which is very troublesome and inefficient for an operator.

On the other hand, different problems are caused in the sack itself. The continuous packing operation tends to cause the outer cylindrical surface of the supply pipe to grow sticky on account of the adhesive agent when the packing operation is continuously performed. If this sticky condition of the pipe is or grows severe enough, the sealing member is torn off by the adhesion of the pipe when the sack is released from the pipe.

SUMMARY OF INVENTION

Thus the present invention is intended to solve or at least improve all the problems mentioned above.

Accordingly, it is an object of this invention to provide a packing operation for powdered materials without any bunging at the slits or holes provided on the supply pipe and without any destruction of the sack itself.

It is another object of this invention to provide a sack with a sealing member with simple construction which enables secure sealing.

It is another object of this invention to provide an apparatus for packing powdered materials into the sack, the apparatus being applicable not only to the sack according to the present invention, but also to any conventional sacks for powdered materials.

It is another object of this invention to provide a method of packing powdered materials into the sack and of sealing the sack itself.

Other objects and features of this invention will be clearly understood by a person who skilled in this field.

BRIEF DESCRIPTION OF DRAWINGS

The invention will be described by way of example, with reference to the accompanying drawings, wherein.

DETAILED DESCRIPTION OF INVENTION

Figure 1:
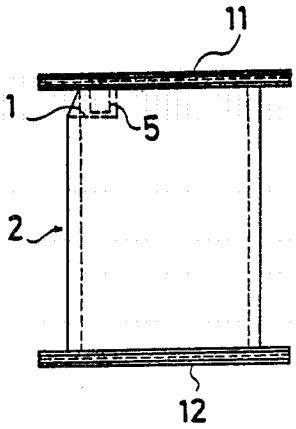
FIG. 1 shows a front view of a sack according to the invention.
Figure 2:
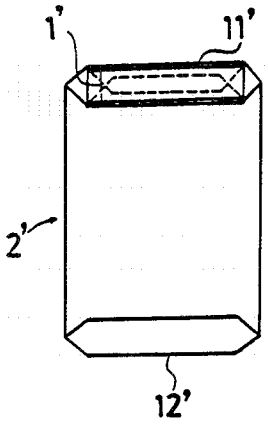
FIG. 2 shows a front view of another sack according to the invention.

Referring to FIGS. 1 and 2 which show two different types of sacks into which powdered materials may be supplied, the first sack 2 shown in FIG. 1 is closed at both the upper and lower ends 11, 12 by sewing and is comprised of treble kraft and is formed with a gore in both sides of the sack, while the second sack 2' shown in FIG. 2 is closed at both the upper and lower ends 11', 12' by pasting, and iscomprised of treble kraft and formed with a gore in both of the ends. A sealing member 1, 1' is provided at an appropriate position of the sack 2, 2' respectively. The sealing member 1, 1' comprises an aperture through which a supply pipe 3 (shown in FIGS. 4 and 5) is inserted into the sack. The inner walls of the sealing member which are opposite to each other include a dried adhesive layer previously formed by spreading and drying an adhesive agent thereon. The adhesive agent to be used for this layer is the type of adhesive that is immediately activated to give to the layer a stick adhesion when an activator (for example water or a certain kind of solvent adaptable to the adhesive agent) is supplied. Thus it is desirable particularly with kraft, to use adhesive agents such as those substantially comprised of natural macromolecules, for example casein or gum arabic, or of synthetic macromolecules, for example polyvinyl alcohol or polyvinyl ether, because such adhesive agents can easily be activated by being dampened again. It is also desirable to choose an adhesive agent that takes a certain amount of time for the agent become sticky, during which time the supply pipe 3 is released from the sack, and that is not affected by an environmental temperature. In such a manner, an adaptable adhesive agent is chosen and is spread on the inner walls of the sealing member, then dried. If it is difficult to form the layer on sack walls that have already been made up, the layer can be formed in the following way. Spreading and drying a chosen adhesive agent on a surface of a strip 5, for example, of kraft; holding the strip so that the adhesive layer faces itself; and pasting the strip thus held to the inner wall of the sack adjacent to the aperture so that the adhesive layer still faces itself. Finally, the ends of the strip 5 may be sewn together with the end 11 of the sack.

The above description is directed to such a case as the sack is made of kraft. However, if the sack is made of canvas, polystyrene may be infiltrated into a part of the sack adjacent to the aperture to form the sealing member.

A sack according to the invention can be easily sealed off after powder materials have been supplied therein, when the sack is made of kraft, by jetting an adapted activator (for example water or a certain kind of solvent adapted to the layer formed on the inner walls of the sealing member) to the inner walls of the sealing member, or, when the sack is made of canvas, by jetting an adapted activator (for example toluene or xylene).

Thus, the sack according the invention does not require that an adhesive agent be directly jetted from slits or fine holes provided on the cylindricalsurface of the supply pipe, but it does require that an adapted activator such as water or a certain kind of solvent be jetted therefrom. An advantageous feature of the invention will be easily understood by a person who skilled in this field, In practical use, the inconvenient problem of bunging at the slits or fine hole of the supply pipe is largely improved, and thus maintenance and efficiency of a packing apparatus is considerably raised.

Figure 4:
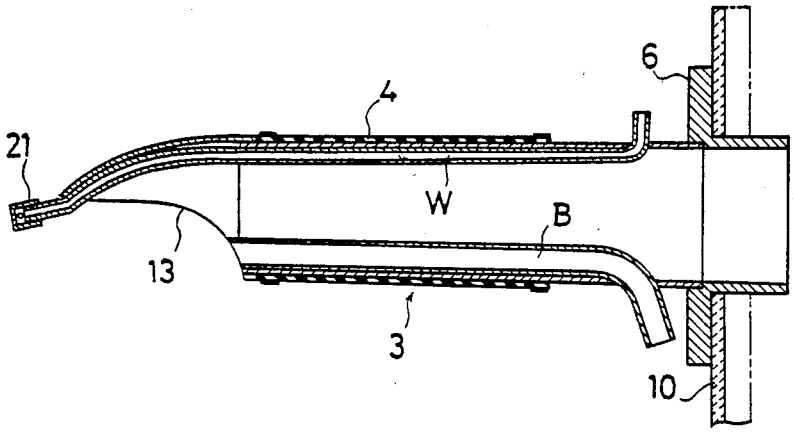
FIG. 4 shows a longitudinal sectional view of a supply pipe according to the invention.
Figure 5:
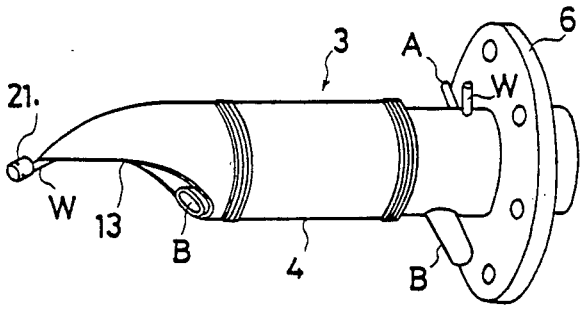
FIG. 5 shows a perspective view of FIG. 4.
Figure 6:
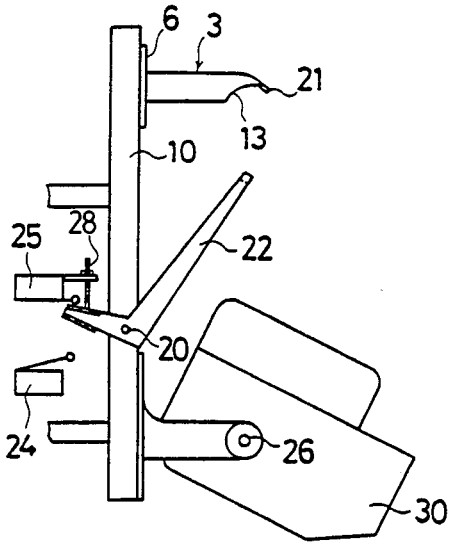
FIG. 6 shows a side view of a packing apparatus which utilizes the supply pipe.
Figure 7:
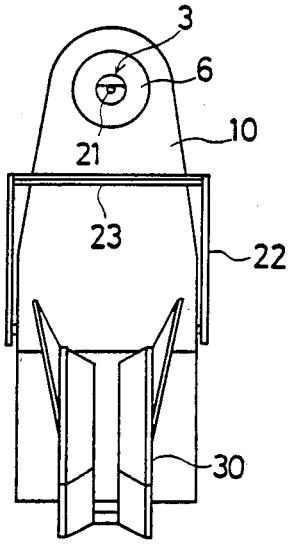
FIG. 7 shows a front view of FIG. 6.

Referring to FIGS. 4 and 5 which shows respectively a construction and an external view of the supply pipe 3, the pipe is fixed to a frame 10 of a packing apparatus by means of a flange 6. The pipe 3 comprises a curved head adapted for insertion into an aperture of the sealing member, and the lower part of the head comprises a port 13 adapted to discharge powdered materials. The rear end of the pipe 3 is connected to a conveying pipe (not shown), which is further connected to a hopper (not shown), through which powdered materials are conveyed. Thus the powder materials stocked in the hopper can be brought to the supply pipe 3 by and together with compressed air. An expansible tube 4 is mounted on the body part of the pipe 3, and both the ends of the tube 4 are respectively firmly fastened on the body part. An air pipe A is provided to the pipe 3 so as to supply compressed air between the tube 4 and the outer surface of the body of the pipe. Thus the tube 4 is expanded by the compressed air supplied through the air pipe A and, when the supply pipe 3 is inserted in the sack, the tube 4 will firmly contact with the adjacent part of the aperture and will stretch it. Thus, the tube 4 can support the sack itself in collaboration with a supporter 30 (shown in FIGS. 6 to 10) provided at the lower part of the packing apparatus, and the tube 4 also serves as a shutting member that closes up the space between the supply pipe 3 and the aperture of the sealing member to prevent the supplied powdered materials from discharging out of the sack through the space. A discharge pipe B is provided within the supply pipe 3 so as to extend to the port 13 at the one end thereof. The other end of the pipe B is connected, via a filter (not shown), to a circuit (not shown) which is open to the air, whereby the compressed air supplied into the sack can be discharged through the discharge pipe B when powdered materials are supplied into the sack. An activator pipe W is provided also within the pipe 3 and extends longitudinally to project from the front end of the head. A jet nozzle 21 is detachably mounted to the front end of the pipe W by screw. The other end of the pipe W is connected, via a solenoid valve (not shown), to an airtight tank in which an activator (for example water or ethanol) is stocked under pressure, for example of 2 $Kg/cm^2G$. Thus the activator can be supplied, under pressure, to the nozzle 21 by controlling the solenoid valve with a micro-switch 25 and a timer, the operations of which will be described hereafter in detail. The nozzle 21 comprises fine holes (for example of four to six) provided on the cylindrical surface thereof, through which the activator is radiallyjetted in spray when the activator is supplied through the pipe W. Thus, the spread and dried adhesive agent of the layer formed on the inner surface of the sealing member is activated by receiving the jetted spray of the activator.

Referring to FIGS. 6 to 10, the packing apparatus comprises, as mentioned above, a frame 10 to which the supply pipe 3 is fixed by means of the flange 6, and the apparatus further comprises a pair of bent levers 22 which are each pivotably mounted to their respective sides of the apparatus by an axle 20. The levers 22 are connected to each other, at the top ends of the longer arms thereof, by a rod 23 which extends laterally relative to the apparatus. A shorter arm of either one of the levers 22 is designed so as to contact alternatively the micro-switches 24, 25 at the lower or the upper position of the shorter arm. As can be seen from FIG. 6, the levers 22 are pivotably mounted on the frame 10 so that a clock-wise moment acts on the axle 20 because of the weight of the levers 22 and of the centroid thereof, when no external force is given thereto. The apparatus further comprises a supporting member 30, which is pivotably mounted by an axle 26 to the frame 10. The axle 26 is connected, via a linkage (not shown), to an operation rod of an air cylinder (not shown). The supporting member 30 is pivotably mounted at the lower part of the apparatus so as to be kept horizontal, when the operation rod is pushed forward, and so as to be kept inclined forward, when the rod is drawn back.

Figure 3:
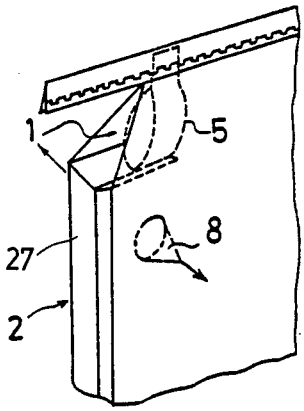
FIG. 3 shows an enlarged perspective view of a part of FIG. 1.
Figure 8:
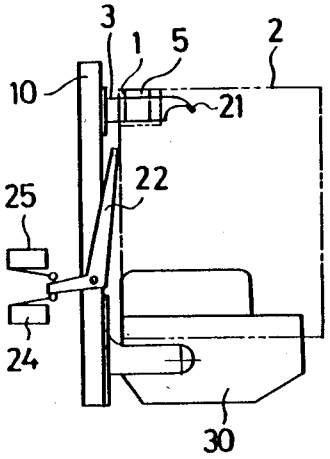

In operation, the pipe 3 is inserted into the sack through the aperture of the sealing member into the sack. After a gore 27 of the sack is expanded by a sucking member 8 of a handling mechanism (not shown) as indicated by the cone with arrow in FIG. 3, the rod 23 is pressed backward by the gore 27, whereby the shorter arm of either one of the levers 22 contacts the micro-switch 24 to close the switch. Then, the compressed air is supplied, through the air pipe A, in response to the operation of the switch 24, whereby the expansible tube 4 is expanded, and simultaneously the compressed air is also supplied to the air cylinder, whereby the operation rod is pushed forward. Thus, as mentioned above, the sack is supported by both the expanded tube 4, at the aperture of the sealing member, and the supporting member 30 which is kept horizontal, at the bottom of the sack (FIG. 8).

Figure 10:
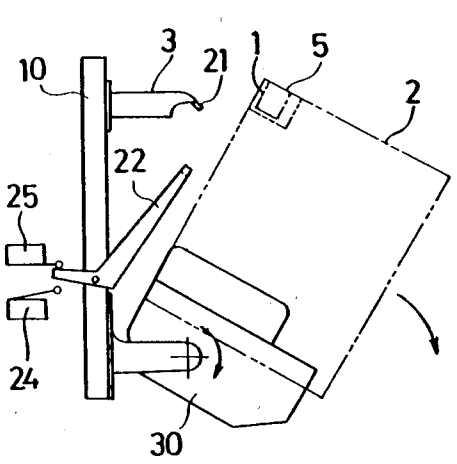
FIGS. 8 to 10 are side views of the packing apparatus, which show its operation in the course of time.
Figure 9:
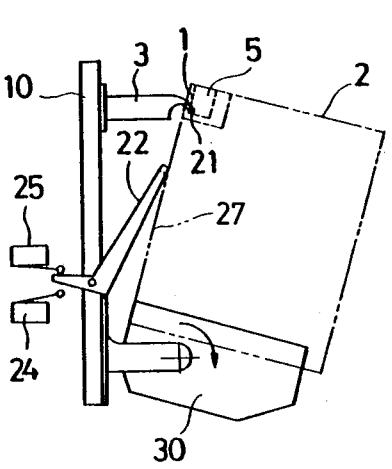

After these operations, the powdered materials stocked in the hopper are supplied, through the supply pipe 3, by and together with the compressed air, into the sack. The compressed air in the sack is discharged through the discharge pipe B, and the powdered materials contained in the discharged air are filtered out by the filter. The weight of powdered material supplied in the sack is automatically measured by a measuring mechanism (not shown) connected to the frame 10, and, when the supplied powdered materials amount to a predetermined weight, the supply of the powder materials is stopped, and then the expanded sack is deflated by discharging the air supplied in the sack. Then, the operation rod of the air cylinder is drawn back by exchanging the supply circuit of the compressed air, whereby the supporting member 30 is inclined forward. Thus, the sack containing a predetermined amount of powdered materials falls down owing to its own weight (FIGS. 9 and 10). When the sack falls down, the bent levers 22 are pivoted following the movement of the sack. The micro-switch 25 is designed so as to be contacted to close by the shorter arm of the lever 22 when the nozzle 21 comes just within the inner walls of the sealing member during the inclination of the sack. The switch 25 is closed when the sack is inclined to a predetermined angle, which can be seen from FIG. 9. After the switch 25 is closed, both the solenoid valve, provided in a predetermined position of a circuit connected to the activator pipe W, and the timer connected to the solenoid valve are operated to supply an activator to the activator pipe W for a predetermined period (for example for 0.1 to 0.3 seconds). Thus the activator is jetted in spray, from the nozzle 21 to the inner walls of the sealing member, while the nozzle 21 is within the inner walls of the sealing member. The inner walls of the sealing member on which an adapted adhesive agent has been previously spread and dried is dampened by the activator, thus a stick adhesion is given.

As can be easily understood, the starting point for jetting the activator from the nozzle 21 is set at the time when the nozzle comes inside of the sealing member. Thus, the starting point is chosen by controlling an adjuster 28 so that the shorter arm of the lever 22 is contacted with the micro-switch 25 just when the shorter arm is stopped by the adjuster 28. On the other hand, the end point of jetting the activator is set at the time when the nozzle 21 is released from the inside of the sealing member, that is, jetting the activator is continued until the nozzle 21 is released from the sack. Thus, the period during when jetting of the activator is continued is determined by setting the timer through previous tests.

The sack containing the powdered materials therein, as shown in FIG. 10, is inclined following the inclination of the supporting member 30, and falls owing to its own weight, for example onto a belt conveyer.

Since the sealing member provided to the sack according to the invention is designed so that the opposite walls of the sealing member are pressed against each other by outward force of the powdered materials supplied in the sack, the sack can be sealed while falling.

Going back to the operation of supplying the powdered materials, although the nozzle 21 is ordinarily exposed to the powdered materials supplied from the port 13 of the supply pipe 3, an activator is jetted from the holes arranged on the cylindrical surface of the nozzle 21, rather than an adhesive agent itself, and bunging at the holes can thereby be prevented. If the powdered material is flour, it is desirable to use ethanol as an activator because flour is not acceptable to ethanol.

In such a manner, it is desirable to choose an adhesive agent which is previously spread and dried on the inner walls of the sealing member and an activator which is used to the dried adhesive agent, in accordance with the kind of powdered material to be packed.

In the above-mentioned embodiments, the supply pipe 3 is used in combination with a sack according to the invention. However, the supply pipe according to the present invention is applicable to any conventional type of sack, which require that an adhesive agent to be directly jetted from the holes of the nozzle 21. In case of application to a conventional type of sack, an adhesive agent itself instead of an activator is designed so as to be jetted from the nozzle 21, under the greater compression in comparison with the foregoing embodiments (for example of 3 to 5 $Kg/cm^2G$) because of the greater viscosity. Even if the undesirable bunging is caused, which is apt to occur inevitably in practical use, the cleaning or maintenance of the supply pipe 3 can be easily performed in the apparatus according to the invention, by simply replacing the bunged nozzle by another.

Another well known method involves sealing the sealing member by means of a heat-melting adhesive agent. The present invention is also applicable to such a heat-melting method. In case of application to such a method, the heat-melting adhesive is previously spread and dried on the inner walls of the sealing member of the sack, and, as before an activator adapted to the adhesive agent is designed so as to be jetted from the nozzle 21. Further, a pair of heat plates is provided at an appropriate position of a belt conveyer on which the falling sack has landed, thereby allowing packing to be performed in the same manner as the foregoing embodiments.

I claim:

1. An apparatus for packing powdered materials into a sack having a sealing member defining an aperture, comprising:

a frame for the apparatus having upper and lower portions;

a supply pipe assembly, mounted to the upper portion of the frame and adapted to be at least partially inserted into the aperture of the sack, for supplying powdered material therethrough into the interior of the sack, the supply pipe assembly having a substantially cylindrical body portion, a curved head adjacent the body portion adapted for insertion into the aperture of the sealing member, an expansible tube mounted on the body portion for shutting the space between the body portion and the sealing member, a port in the front end of the head through which powdered material is supplied to the sack, and a nozzle detachably mounted to and projecting from the front end of the head which is provided with a plurality of fine holes through which fluid is jetted to produce an adhesion on the sealing member when the nozzle is within the sealing member;

a supporting member for supporting the sack, mounted to the lower portion of the frame and selectively pivotable between a substantially horizontal position wherein powdered material is supplied to the sack, and a forward inclined position which is assumed after the supplying of powdered material to the sack is complete, detecting means for detecting the installation of the sack upon the supply pipe assembly to thereby initiate the supplying of powdered material to the sack, and for detecting a predetermined inclination of the sack after a predetermined amount of powdered materials have been supplied to the sack to thereby initiate sealing of the sack, said detecting means including a first switch and a bent lever having first and second arm portions, the lever being pivotably mounted on the frame and movable between a first position wherein the first arm portion contacts the sack when the sack is in a first position relative to the supply pipe assembly and is ready to receive powdered material, and a second position wherein the first arm portion contacts the sack when the sack is in a second position relative to the supply pipe assembly such that the sealing member is ready to receive fluid jetted from the nozzle and the second arm portion operates the first switch, thereby initiating jetting of the fluid; and adjuster means for limiting the movement of the second arm portion, thereby controlling when the second arm portion operates the first switch.

2. An apparatus according to claim 1, wherein the detecting means includes a second switch to initiate the supplying of powdered material, said second switch being located adjacent to the adjuster means, and being operated by the second arm portion when the first arm portion is in its second position.

* * * * *